US012066276B2

(12) United States Patent
Bugge et al.

(10) Patent No.: US 12,066,276 B2
(45) Date of Patent: Aug. 20, 2024

(54) SABOT OR COVER FOR SEEKERS, SENSITIVE WINDOWS AND SURFACE ELEMENTS ON GUN LAUNCHED MUNITIONS

(71) Applicant: Raytheon Company, Waltham, MA (US)

(72) Inventors: John F. Bugge, Hertford, NC (US); Byron Terence Edgar, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 196 days.

(21) Appl. No.: 17/737,428

(22) Filed: May 5, 2022

(65) Prior Publication Data

US 2023/0358518 A1 Nov. 9, 2023

(51) Int. Cl.
*F42B 14/06* (2006.01)

(52) U.S. Cl.
CPC ..... *F42B 14/064* (2013.01); *F42B 14/06* (2013.01); *F42B 14/067* (2013.01)

(58) Field of Classification Search
CPC ..... F42B 14/06; F42B 14/061; F42B 14/062; F42B 14/064; F42B 14/067; F42B 14/068; F42B 10/46; F42B 10/52
See application file for complete search history.

(56) References Cited

U.S. PATENT DOCUMENTS 2,655,106 A 10/1953 O'Brien
3,148,472 A * 9/1964 Hegge ..... F42B 14/062 89/14.05
4,029,018 A * 6/1977 Bjornson ..... F42B 14/061 102/521
4,382,411 A * 5/1983 Ambrosini ..... F42B 14/061 102/525
4,459,725 A * 7/1984 Mariaux ..... F42B 10/46 29/451
4,714,024 A * 12/1987 Bocker ..... F42B 14/061 102/521
4,757,766 A * 7/1988 Ruffle ..... F42B 14/061 102/521

(Continued)

FOREIGN PATENT DOCUMENTS

EP 288657 A * 11/1988 ..... F42B 14/061

OTHER PUBLICATIONS

Partial International Search issued Jun. 15, 2023 in counterpart International Application No. PCT/US2023/014767.

(Continued)

*Primary Examiner* — Gabriel J. Klein

(74) *Attorney, Agent, or Firm* — Bachman & LaPointe, P.C.

(57) ABSTRACT

A sabot including a first casing petal having at least one coupling feature and at least one disengagement feature; a second casing petal having at least one coupling feature and at least one disengagement feature; and a cap insertable within a forward receiver formed by coupling the first casing petal with the second casing petal, wherein the first casing petal and the second casing petal and the cap are configured to cooperatively attach to a forward assembly of a missile and cooperatively detach from the forward assembly of the missile responsive to a missile launch.

21 Claims, 9 Drawing Sheets

(56) References Cited

U.S. PATENT DOCUMENTS 4,802,415 A * 2/1989 Clarke ..... F42B 14/067 102/434
4,901,646 A * 2/1990 Feldmann ..... F42B 14/067 102/521
4,953,466 A * 9/1990 von Gerlach ..... F42B 14/06 102/521
5,272,982 A * 12/1993 Desevaux ..... F42B 5/045 102/466
5,467,716 A * 11/1995 Boual ..... F42B 5/045 102/434
7,082,878 B2 8/2006 Facciano et al.
7,506,572 B1 * 3/2009 Hombeck ..... F42B 14/06 89/31
8,093,487 B2 * 1/2012 Kimerer, Jr. ..... F42B 19/005 102/390
8,461,501 B2 1/2013 Williams et al.
8,497,456 B2 7/2013 Eisentraut
8,519,312 B1 * 8/2013 Merems ..... F42B 15/36 244/119
8,931,738 B2 1/2015 White et al.
9,121,668 B1 9/2015 Edwards
2006/0169841 A1 8/2006 Dulat et al.
2011/0192308 A1 8/2011 Fisch et al.
2012/0104149 A1 * 5/2012 Williams ..... F42B 15/34 29/428
2015/0226525 A1 8/2015 Edwards

OTHER PUBLICATIONS

International Search Report and Written Opinion issued Aug. 7, 2023 in counterpart International Application No. PCT/US2023/014767.

* cited by examiner

SABOT OR COVER FOR SEEKERS, SENSITIVE WINDOWS AND SURFACE ELEMENTS ON GUN LAUNCHED MUNITIONS

GOVERNMENT LICENSE RIGHTS

This invention was made with Government support under contract W15QKN-14-9-1001 DOTC-17-01-INIT0987, awarded by the United States Department of Defense. The Government has certain rights in this invention.

BACKGROUND

The following disclosure relates generally to guided munitions and, more particularly, to embodiments of guided munitions including self-deploying dome covers.

Demands for increased munition portability, versatility, and ruggedness have lead to the development and implementation of guided missiles with protective covers, which can be stowed within containers prior to launch. Guided missiles include a homing guidance system or "seeker" containing one or more electromagnetic ("EM") radiation sensors, which detect electromagnetic radiation emitted by or reflected from a designated target. A guided missile can also include a nose-mounted seeker dome, which protects the seeker's components while enabling transmission of electromagnetic waves within the sensor bandwidth(s) through the dome and to the seeker's EM radiation sensors.

Guided missiles are prone to dome contamination during missile launch. Guided by the walls of the surrounding launch container, exhaust from the missile's rocket motor flows over and around the missile body in an aft-fore direction during missile launch to blow-off the container cover and thereby facilitate passage of the missile through the container's open end. Direct exposure between the motor exhaust and seeker dome can thus occur during missile launch, which may result in the deposition of harsh chemicals, soot, and other exhaust materials over the dome's outer surface. Dome contamination can block, attenuate, or otherwise interfere with the transmission of electromagnetic signals through the dome and thereby negatively impact the missile's guidance capabilities.

A dome cover can be positioned over a missile dome to minimize or prevent dome contamination during missile launch. However, inflight removal of the dome cover is required to enable subsequent operation of the seeker's EM radiation sensors. Various types of deployment systems (e.g., actuators and timing electronics) have been developed that can effectively remove a dome cover by either ejecting the cover (if fabricated from a non-frangible material) or by initiating fracture of the cover (if fabricated from a frangible material) during or immediately after missile launch. While able to effectively remove a dome cover at a desired time of deployment, such deployment systems add undesirable complexity, cost, bulk, and weight to the guided missile.

There is a continuing need to protect powered missiles from damage before, during, and after launch.

SUMMARY

In accordance with the present disclosure, there is provided a sabot comprising a first casing petal having at least one coupling feature and at least one disengagement feature; a second casing petal having at least one coupling feature and at least one disengagement feature; and a cap insertable within a forward receiver formed by coupling the first casing petal with the second casing petal, wherein the first casing petal and the second casing petal and the cap are configured to cooperatively attach to a forward assembly of a missile and cooperatively detach from the forward assembly of the missile responsive to a missile launch.

A further embodiment of any of the foregoing embodiments may additionally and/or alternatively include each of the first casing petal and the second casing petal are identically shaped.

A further embodiment of any of the foregoing embodiments may additionally and/or alternatively include the at least one coupling feature comprises an arm and a landing cooperatively coupled proximate a forward sabot.

A further embodiment of any of the foregoing embodiments may additionally and/or alternatively include the at least one coupling feature comprises a central interface formed between the first casing petal and the second casing petal near the arm and landing; wherein the central interface includes a crotch at a base end of the arm configured to receive a nub proximate the landing of the second casing petal.

A further embodiment of any of the foregoing embodiments may additionally and/or alternatively include the at least one coupling feature comprises a hook and a notch cooperatively coupled, wherein the hook is a projection from the first casing petal, the hook comprising a curved portion; and wherein the notch is formed in the second casing petal, the notch includes a pitched face, formed at an angle relative to an axis A, the pitched face cooperates with the curved portion of the hook.

A further embodiment of any of the foregoing embodiments may additionally and/or alternatively include the sabot further comprising a latch comprising a lock pin that rides in a first bore formed in the first casing petal and complementary second bore formed in the second casing petal; the first bore being located within the arm, the second bore being located adjacent the landing.

A further embodiment of any of the foregoing embodiments may additionally and/or alternatively include the sabot further comprising a forward assembly receiving cavity formed by the first casing petal and the second casing petal being coupled together, the forward assembly receiving cavity being configured to receive the forward assembly.

A further embodiment of any of the foregoing embodiments may additionally and/or alternatively include the at least one coupling feature comprises a key formed in each of the first casing petal and the second casing petal, wherein the key comprises raised portions including an inclined surface clip that engages a slot formed in an exterior surface of the forward assembly.

A further embodiment of any of the foregoing embodiments may additionally and/or alternatively include the at least one disengagement feature includes a slot formed proximate a sabot aft end, wherein the slot includes a swept edge of the sabot proximate the notch, the slot being proximate an adjacent portion proximate the aft sabot end of the first casing petal and configured to swing in a radial direction, such that a forward sabot end swings radially in an opposite direction relative to the axis A.

A further embodiment of any of the foregoing embodiments may additionally and/or alternatively include the sabot further comprising a blow-by vent comprising a groove adjacent ridges formed in a sabot exterior.

A further embodiment of any of the foregoing embodiments may additionally and/or alternatively include the at least one disengagement feature comprises an air scoop located within the forward receiver, the air scoop comprising a slot formed in each of the first casing petal and the second casing petal proximate the forward receiver, wherein the air scoop is configured for air to flow inward through the forward receiver and past a perimeter of the cap to enter a forward assembly receiving cavity of the sabot.

A further embodiment of any of the foregoing embodiments may additionally and/or alternatively include the at least one disengagement feature includes an aerodynamic feature formed on a forward surface of the cap, the aerodynamic feature configured to interact with onrushing air to destabilize the cap to remove the cap at a predetermined time during the missile launch.

In accordance with the present disclosure, there is provided a process for covering and uncovering a forward assembly on a missile of a gun launched munition with a sabot comprising: attaching a first casing petal to a portion of the forward assembly; attaching a second casing petal to another portion of the forward assembly; coupling together the first casing petal to the second casing petal using at least one coupling feature; nesting a cap between the first casing petal and the second casing petal in a forward receiver formed by the first casing petal and the second casing petal proximate a forward end of the sabot; responsive to a launch of the missile, actuating at least one disengagement feature of the sabot; removing the first casing petal and the second casing petal from the forward assembly; and removing the cap from the forward receiver and away from the forward assembly.

A further embodiment of any of the foregoing embodiments may additionally and/or alternatively include the first casing petal and the second casing petal are identically shaped.

A further embodiment of any of the foregoing embodiments may additionally and/or alternatively include actuating the disengagement feature comprises releasing a latch, the latch comprising a lock pin that rides in a first bore formed in the first casing petal and complementary second bore formed in the second casing petal.

A further embodiment of any of the foregoing embodiments may additionally and/or alternatively include the at least one coupling feature comprises at least one of: an arm and a landing cooperatively coupled or decoupled proximate a forward sabot end; a central interface formed between the first casing petal and the second casing petal near the arm and landing; a hook formed in the first casing petal and a notch formed in the second casing petal, the hook and the notch cooperatively coupled or decoupled; and a key formed in each of the first casing petal and the second casing petal, wherein the key comprises raised portions including an inclined surface clip that engages a slot formed in an exterior surface of the forward assembly.

A further embodiment of any of the foregoing embodiments may additionally and/or alternatively include the decoupling feature comprises at least one of: a slot formed proximate a sabot aft end, wherein the slot includes a swept edge of the sabot proximate the notch, the slot being proximate an adjacent portion proximate the aft sabot end of the first casing petal and configured to swing in a radial direction, such that a forward sabot end swings radially in an opposite direction relative to an axis A; an air scoop located within the forward receiver, the air scoop comprising a slot formed in each of the first casing petal and the second casing petal proximate the forward receiver; and an aerodynamic feature formed on a forward surface of the cap, the aerodynamic feature configured to interact with onrushing air to destabilize the cap to remove the cap at a predetermined time.

A further embodiment of any of the foregoing embodiments may additionally and/or alternatively include the process further comprising venting gases past the sabot by use of a blow-by vent comprising a groove adjacent ridges formed in a sabot exterior.

A further embodiment of any of the foregoing embodiments may additionally and/or alternatively include the process further comprising actuation of the at least one disengagement feature responsive to a decoupling force, the decoupling force being selected from the group consisting of momentum of the missile, aerodynamic forces acting on the sabot, gas pressure, a spring, an explosive charge and combinations thereof.

A further embodiment of any of the foregoing embodiments may additionally and/or alternatively include the process further comprising the first casing petal and the second casing petal tumbling away from the forward assembly and clearing away from the missile; and the cap disengaging from the forward assembly and moving clear of a dome and exterior surface of the forward assembly and the missile at a predetermined time after exiting a muzzle of a barrel.

Other details of the sabot are set forth in the following detailed description and the accompanying drawings wherein like reference numerals depict like elements.

DETAILED DESCRIPTION

Figure 1:
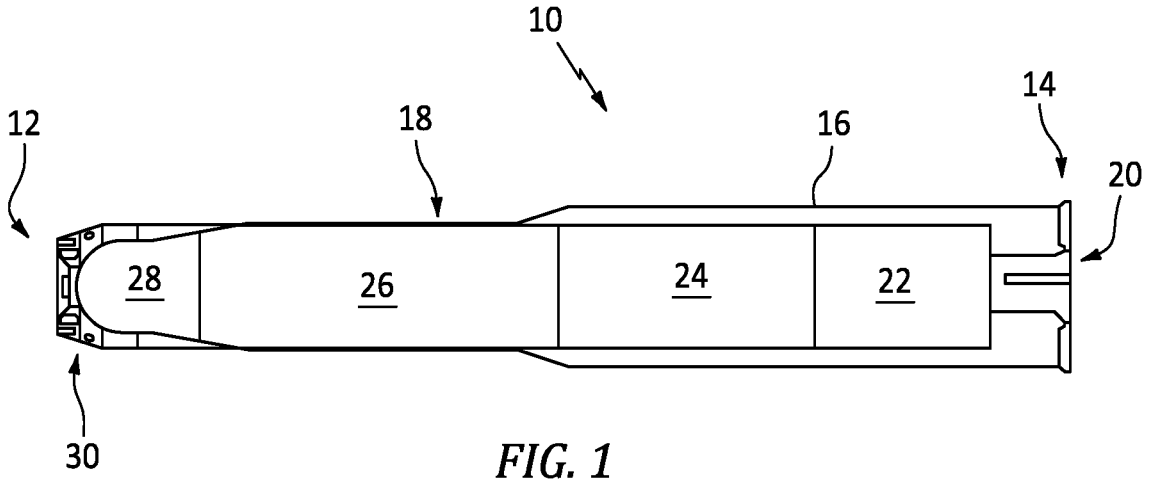
FIG. 1 is a schematic representation of a gun launched munition with a sabot.
Figure 2:
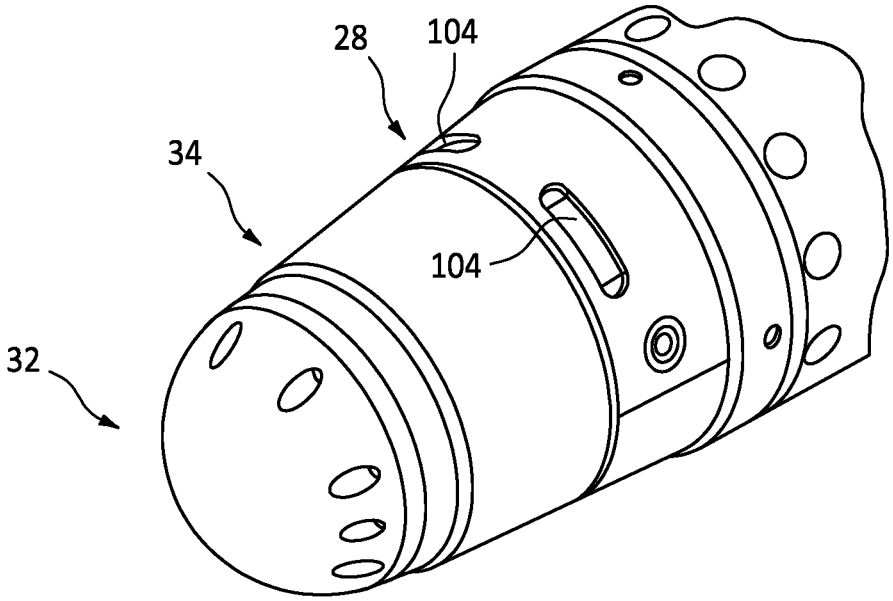
FIG. 2 is a schematic representation of a forward assembly of the gun launched munition.

Referring now to FIG. 1, there is illustrated a gun launched munition 10. The munition 10 has a forward end 12 and after or simply aft end 14 opposite the forward end 12. The gun launched munition 10 can include a cartridge case 16 enclosing a missile 18. The cartridge case 16 supports a charge and primer assembly 20 located in the aft end 14. The missile 18 includes a tail kit assembly 22 located proximate the aft end 14. A warhead assembly 24 is located forward of and proximate the tail kit assembly 22. Controls and batteries 26 are forward of and adjacent the warhead assembly 24. A forward assembly 28 is forward and adjacent the controls and batteries 26. A sabot 30 covers the forward assembly 28. Referring also to FIG. 2, the forward assembly 28 can include a seeker and optical (visual/IR) guidance equipment covered by a dome 32. The equipment in the forward assembly 28 can be delicate and can be vulnerable to physical damage during transportation, storage, loading and firing processes.

Referring also to FIGS. 3 through 7, the sabot 30 is configured to cover the forward assembly 28 exterior 34 and provide protection from physical damage during transportation, storage, loading and firing processes of the munition 10. The sabot 30 is configured to be discarded responsive to the missile 18 exiting the muzzle of a gun (not shown).

Figure 6:
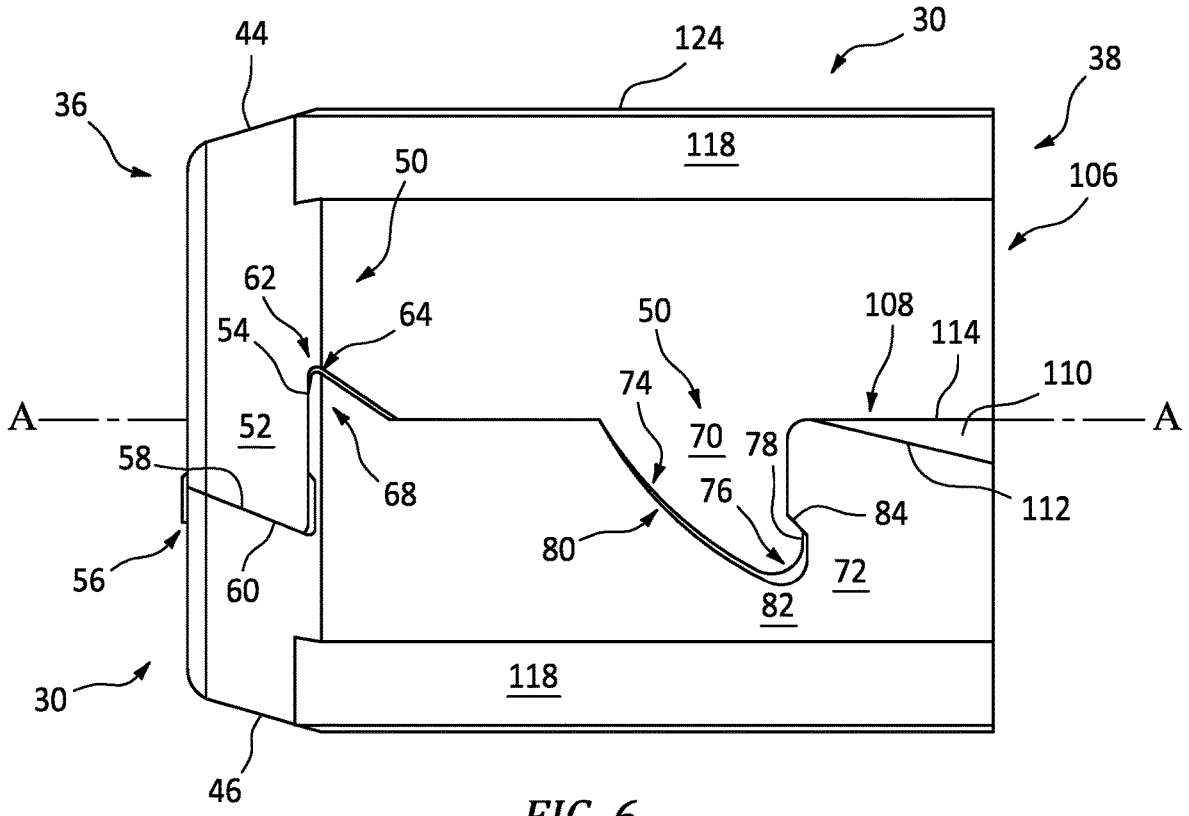
FIG. 6 is a side view schematic representation of the exemplary sabot.

The sabot 30 includes a forward end 36 and an aft end 38 opposite the forward end 36 with respect to an axis A (shown at FIG. 6). A cap 40 is located at the forward end 36 and disposed in a forward receiver 42 formed between a first casing petal 44 and a second casing petal 46. The cap 40 can be positioned proximate the dome 32 when the sabot 30 is assembled on the forward assembly 28.

Each casing petal 44, 46 can be identically shaped. When coupled together, the first casing petal 44 and the second casing petal 46 interlock to secure to the forward assembly 28. The first casing petal 44 and the second casing petal 46 are demountably coupled together, capable of being decoupled and disassembled at a predetermined time during muzzle exit or even delaying decoupling after a predetermined time after muzzle exit when the missile is ejected from the muzzle of a gun.

In an exemplary embodiment the first casing petal 44 and the second casing petal 46 couple together to form a forward assembly receiving cavity 48. The forward assembly receiving cavity 48 is shaped to conform with and enclose the forward assembly 28 portion of the missile 18.

Referring also to FIGS. 8 through 11, each casing petal 44, 46 includes coupling features 50. The coupling features 50 are configured to ensure the casing petals 44, 46 and cap 40 are securely fitted to the forward assembly 28. The coupling features 50 can include an arm 52 and cooperating landing 54 proximate the sabot forward end 36. The arm 52 extends radially relative to the axis A in the first casing petal 44. The arm 52 of the first casing petal 44 overlaps the landing 54 of the second casing petal 46. The overlap between the arm 52 and landing 54 of the first casing petal 44 and second casing petal 46 respectively provides a physical barrier to disengagement in the axial or rotary direction relative to axis A.

FIG. 6 shows each of the casing petals 44, 46 also include a first forward slanted interface 56 proximate the arm 52 and landing 54. The forward slanted interface 56 includes a slanted face 58 at a distal end of the arm 52 and a matching slanted shoulder 60 proximate the landing 54. The slanted face 58 of the arm 52 and the slanted shoulder 60 of the landing 54 cooperate to form another barrier to relative motion between the first casing petal 44 and the second casing petal 46 once they are fitted together. The forward slanted interface 56 also allows for interference free decoupling when needed.

A central interface 62 is formed between the first casing petal 44 and the second casing petal 46 near the arm 52 and landing 54. The central interface 62 includes a crotch 64 at a base end 66 of the arm 52 configured to receive a nub 68 proximate the landing 54 of the second casing petal 56. The nub 68 interlocks with the crotch 64 and blocks relative motion between the first casing petal 44 and second casing petal 46. Similarly to the forward slanted interface 56 the central interface 62 is configured to allow for low interference release and separation of the first casing petal 44 from the second casing petal 46. It should be understood that each of the first casing petal 44 and the second casing petal 46 are mirrored, that is the same design, so that each cooperates to form a first forward slanted interface 56 as seen in FIG. 6 and a second forward slanted interface (not seen in FIG. 6). The assembly of the first casing petal 44 with the second casing petal 46 allows for at least one forward slanted interface 56, central interface 62. In the embodiment shown, there are two slanted interfaces 56 and two central interfaces 62.

Additional coupling features 50 include a hook 70 and notch 72 arrangement as seen in FIG. 6. The hook 70 is a projection 74 from the first casing petal 44. The hook 70 includes a curved portion 76 that enables low friction release. The hook 70 can include a finger 76 that curls to form a ridge 78. The notch 72 is formed in the second casing petal 46 and includes a pitched face 80, formed at an angle relative to the axis A that cooperates with the curved portion 74 of the hook 70 that also enables a low friction release when the first casing petal 44 and the second casing petal 46 disengage. The notch 72 is configured with a valley 82 that can receive the finger 76 of the hook 70. A lug 84 is formed in the notch 72 that engages the ridge 78 to secure the first casing petal 44 and second casing petal 46. As with the other coupling features 50, the hook 70 and notch 72 interact to secure the two casing petals 44, 46 in a fixed position, free from motion in the axial or radial directions. In the embodiment shown, there are two hook 70 and notch 72 arrangements, but are not limited to this count. The hook 70 and notch 72 can be separated upon release of a latch mechanism 86 seen in FIG. 8.

The latch 86 can include a lock pin 88 that rides in a first bore 90 and complementary second bore 92. The first bore 90 can be located within the arm 52. The second bore 92 can be located within the landing 54. A detent 94 can engage/disengage a keeper 96 formed in the lock pin 88. The detent 94 can be biased, such as with springs and configured to release at a predetermined value, based on a projected decoupling force 98. In an exemplary embodiment, the decoupling force 98 can be g-forces that range from 35 to 90 pounds force (lbf). The latch mechanism 86 can be located in alternative locations where a portion of the first casing petal 44 interfaces with a portion of the second casing petal 46. It is also contemplated that alternative embodiments of the latch mechanism 86 can be envisioned.

Figure 5:
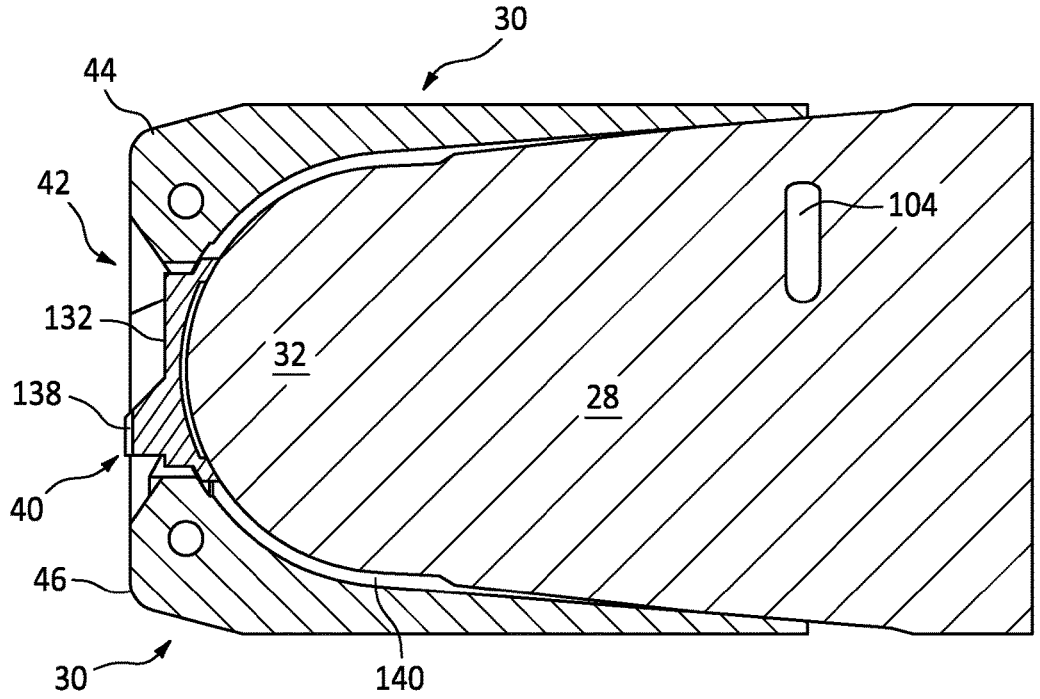
FIG. 5 is a schematic representation of a side cross section of the exemplary sabot fitted over the forward assembly.
Figure 7:
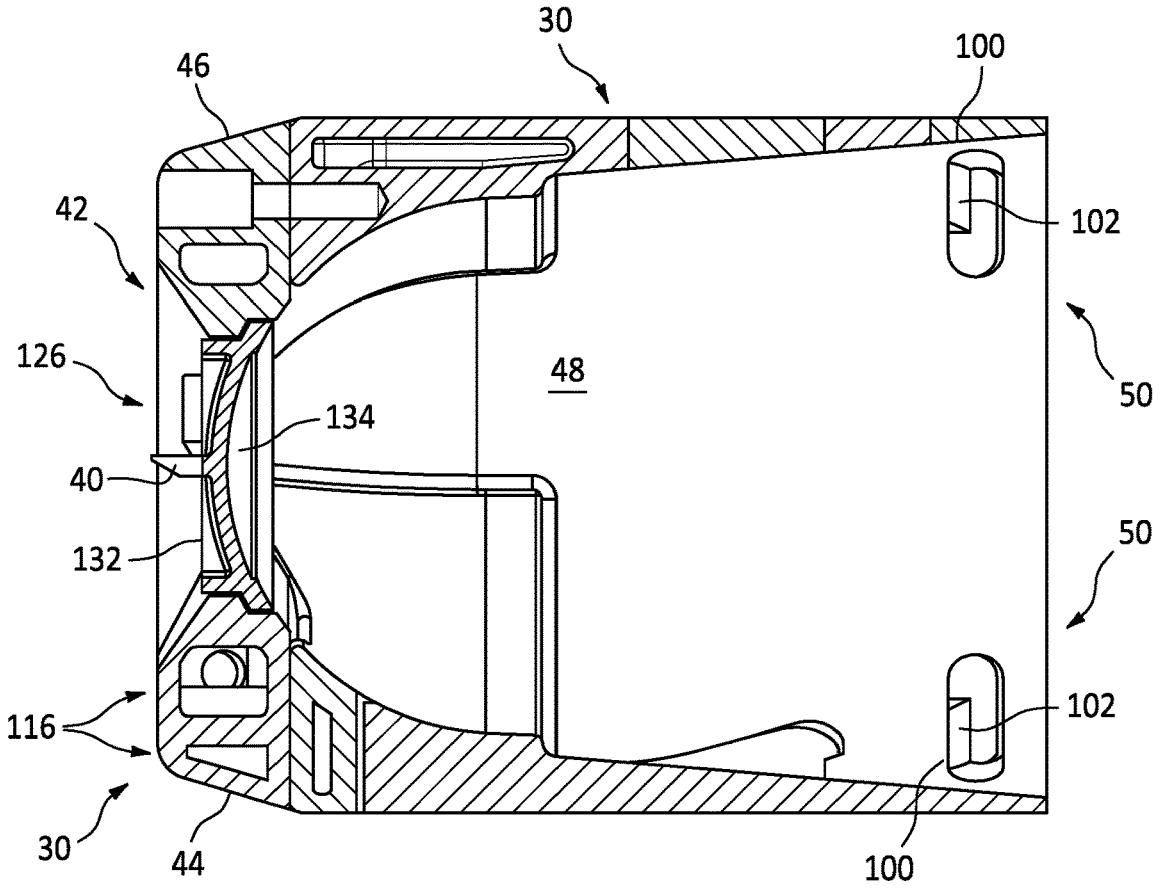
FIG. 7 is a schematic representation of a side view cross section of the exemplary sabot.
Figure 8:
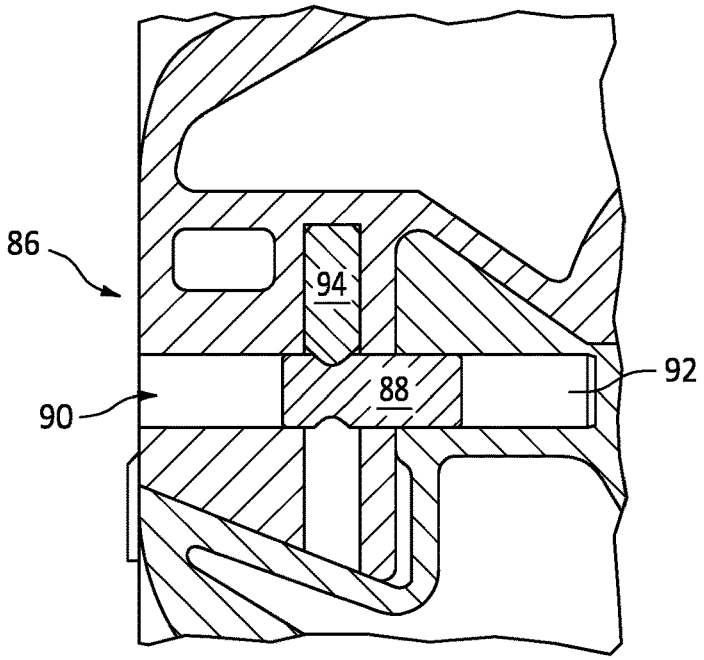
FIG. 8 is a schematic representation of a cross sectional detail of the sabot latch mechanism.
Figure 9:
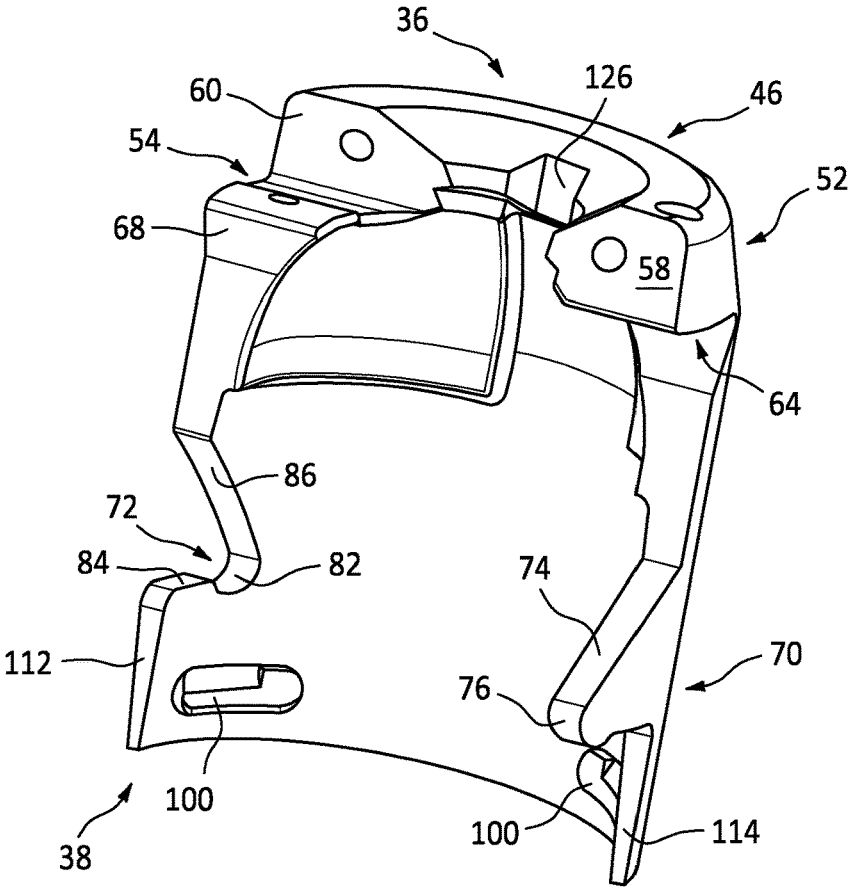
FIG. 9 is a schematic representation of an isometric view of a single portion of the sabot.
Figure 11:
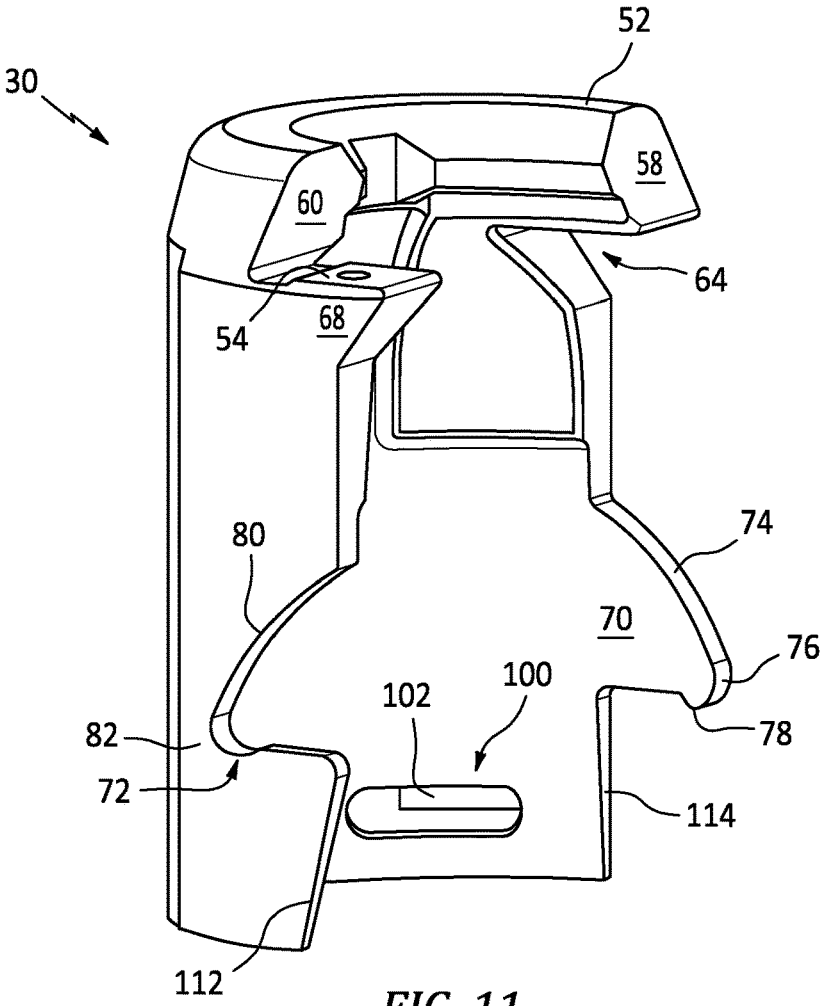
FIG. 11 is a schematic representation of an isometric view of a single portion of the sabot.
Figure 13:
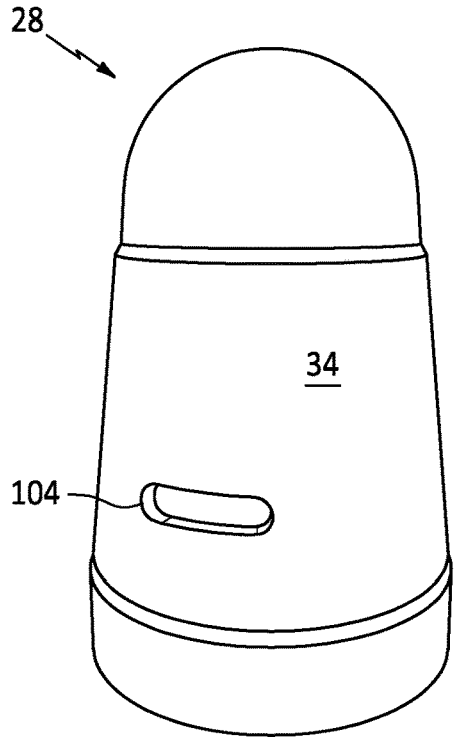
FIG. 13 is a schematic representation of an exemplary forward assembly.

An additional coupling feature 50, as seen in FIG. 7, FIG. 9 and FIG. 11, can include keys 100 formed in each of the first casing petal 44 and the second casing petal 46. The key 100 is raised portion that can include an inclined surface clip 102 that engages slot 104 to secure the petals 44, 46 to the forward assembly 28. The keys 100 can be fit into slots 104 formed in the exterior surface 34 of the forward assembly 28, as seen in FIG. 2, FIG. 5 and FIG. 13. These coupling features 50 attach the aft sabot end 38 to the forward assembly 28.

The sabot 30 also includes at least one disengagement feature 106. The disengagement feature 106 facilitates the removal of the sabot 30 from the forward assembly 28. A first disengagement feature 108 includes a slot 110 formed proximate the sabot aft end 38. The slot 110 can be formed by use of a swept edge 112 of the sabot 30. The swept edge 112 can be proximate the notch 72. The slot 110 allows for the adjacent portion 114 proximate the aft sabot 38 of the first casing petal 44 to freely swing without interference in a radial direction, thus allowing the forward sabot end 36 to swing radially in an opposite direction, that is, away from the axis A.

Figure 3:
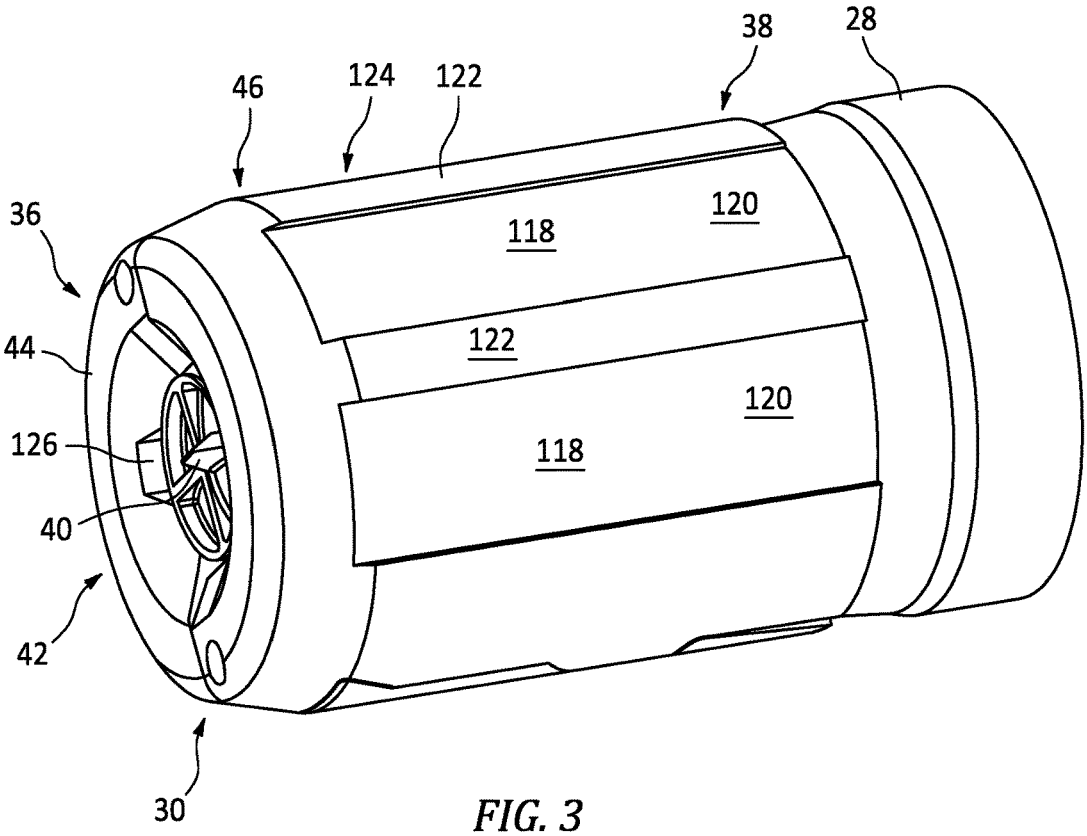
FIG. 3 is an isometric view schematic representation of an exemplary sabot over the forward assembly.

The sabot 30 can include blow-by features/vent 118, as seen in FIG. 3 and FIG. 6 that facilitate high pressure expanding gases (not shown) that flow from aft to forward during launch. The high pressure expanding gases accelerate more rapidly than the missile 18 during launch. The blow-by vent 118 vents those gases to prevent over-pressurization. The blow-by vent 118 can include a groove 120 between ridges 122. The blow-by vent 118 can be located around a sabot exterior 124. The ridges 122 can also be employed to engage the barrel internal surfaces (not shown) during launch. The ridges 122 can provide low friction contact with the barrel internal surfaces.

Figure 4:
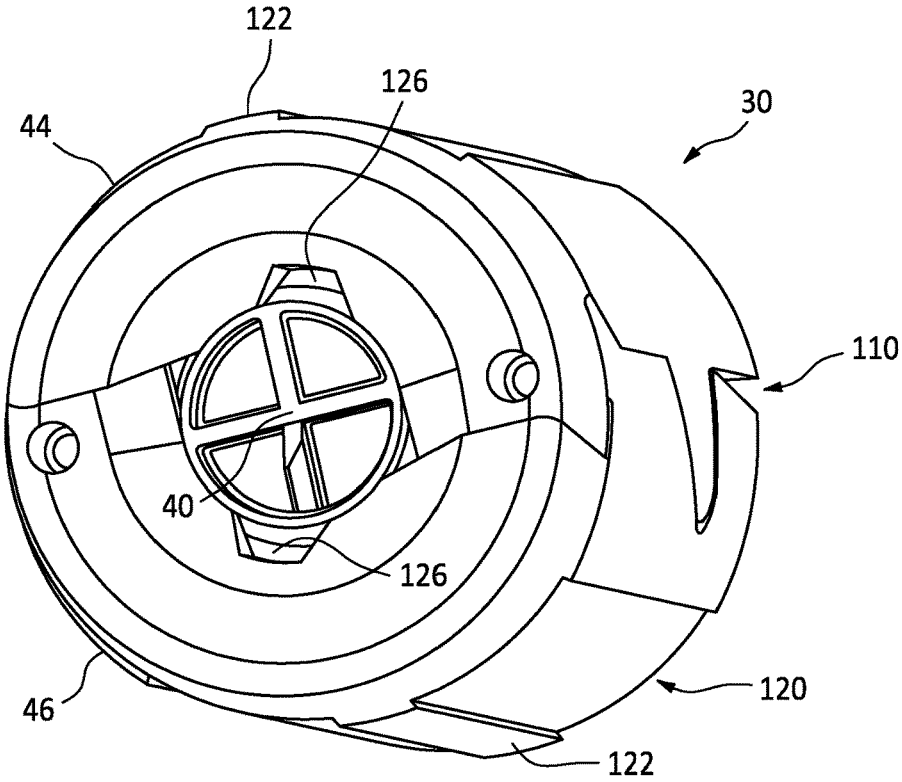
FIG. 4 is an isometric view schematic representation of the sabot.

Another disengagement feature 106 can include an air scoop 126 located within the forward receiver 42 as seen in FIG. 3, FIG. 4 and FIG. 7. The air scoop 126 can be a slot formed in each of the casing petals 44, 46 at the forward receiver 42. The air scoop 126 allows for air to flow inward through the forward receiver 42 and past the perimeter 128 of the cap 40. During launch the air pressure at the forward end 36 of the sabot 30 increases. The air scoop 126 allows for air to flow into the forward receiver 42 and enter the forward assembly receiving cavity 48 of the sabot 30. There is a gap 140 between the sabot 30 and the forward assembly 28, as seen in FIG. 5, that prevents unwanted air pressure buildup within the aft sabot end 38 and also an exit pressure void. The air entering through the air scoop 126 provides impetus to separate the first casing petal 44 and second casing petal 46 after detachment of the latch 72.

Figure 12:
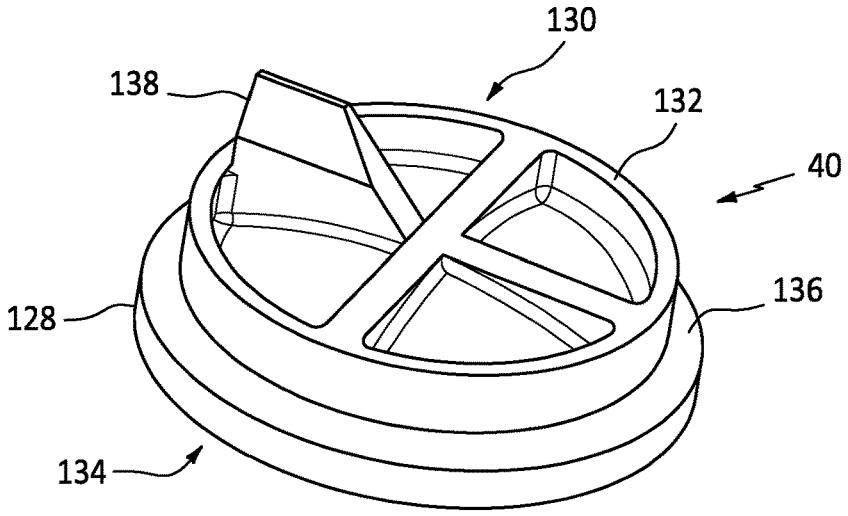
FIG. 12 is a schematic representation of an exemplary cap.

The cap 40 can be seen in more detail at FIG. 12. The cap 40 includes a body 130 formed in a circular shape to cover the forward receiver 42 and protect the dome 32. The body 130 includes a forward surface 132 and an aft surface 134 opposite the forward surface 132. The aft surface 134 can include a relief configured to prevent contact with sensitive surfaces of the dome 32, such as a lens. The aft surface 134 can include a seal near the rim 136, configured to prevent ingress of debris on the dome 32. The forward surface 134 faces outward and the aft surface 134 is convex and faces the dome 32. The body 130 includes a rim 136 proximate the perimeter 128 that abuts and interlocks with the forward receiver 42 of the sabot 30. The body 130 also includes an aerodynamic feature 138 that is configured to interact with the onrushing air, during launch. The aerodynamic feature 138 is another disengagement feature 106. The aerodynamic feature 138 is configured to destabilize the cap 40 to remove the cap 40 from the dome 32 at a predetermined time during launch. The aerodynamic feature 138 can include a fin, tab, slanted surface and the like formed on the forward surface 132 of the cap 40. In another exemplary embodiment, the cap 40 can be tethered to one of the casing petals 44, 46 in order to pull the cap free of the dome 32 after launching the missile 18. In another exemplary embodiment, the cap 40 can engage with one of the identical petals 44, 46, so as to ensure deployment of the cap 40 together with the petal 44, 46 instead of a tether.

Figure 10:
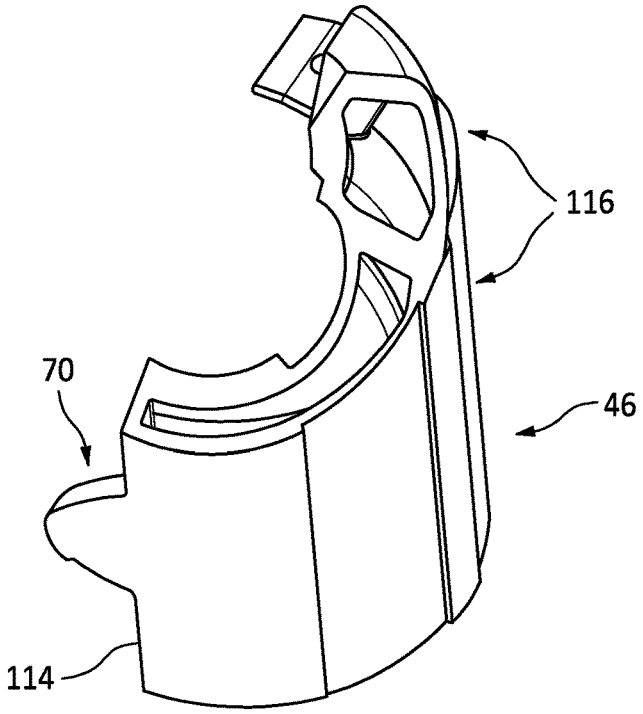
FIG. 10 is a schematic representation of an isometric view of a single portion of the sabot.

The sabot 30 can be formed to be light weight of low mass, as seen in FIG. 7 and FIG. 10, partial cross section view shows cavities 116 hollowed out throughout the casing petals 44, 46. In an exemplary embodiment, the sabot 30 can weigh from 1 pound up to 1.5 pounds. The low mass features of the sabot 30 enables the sabot 30 components 40, 44, 46 to tumble, disperse their kinetic energy and exit with low impact on the missile 18, especially the forward assembly 28.

Figure 14:
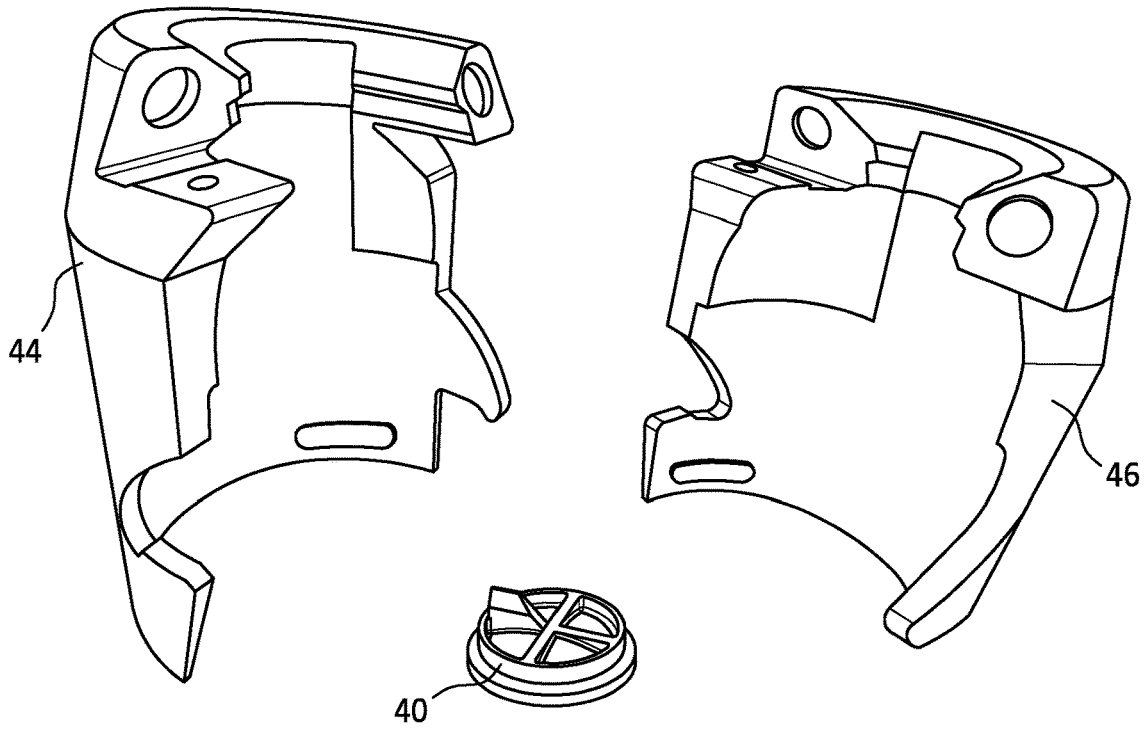
FIG. 14 is a schematic representation of an exemplary sabot disassembled
Figure 15:
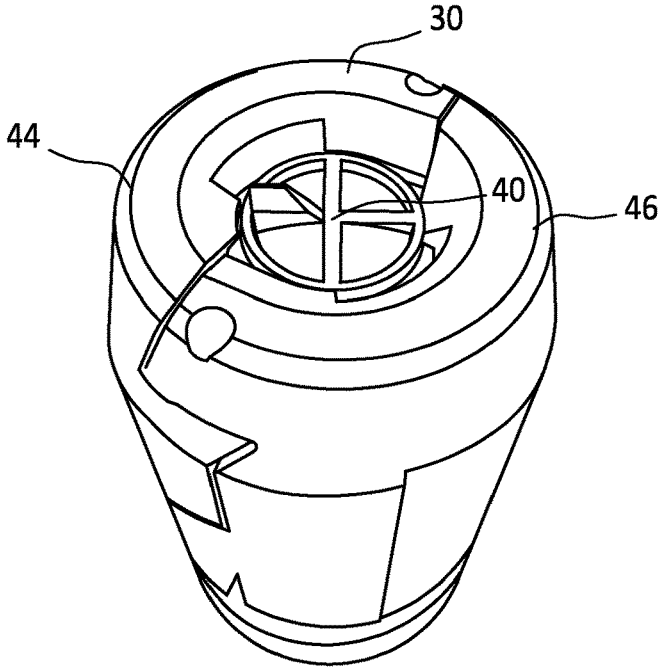
FIG. 15 is a schematic representation of an isometric view of the exemplary sabot fitted on the forward assembly.
Figure 16:
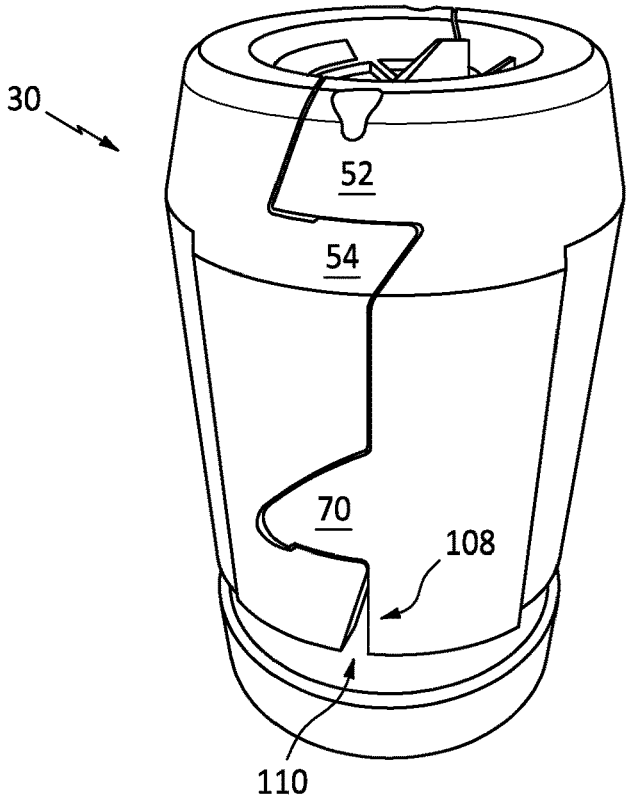
FIG. 16 is a schematic representation of an isometric view of the exemplary sabot fitted on the forward assembly.
Figure 17:
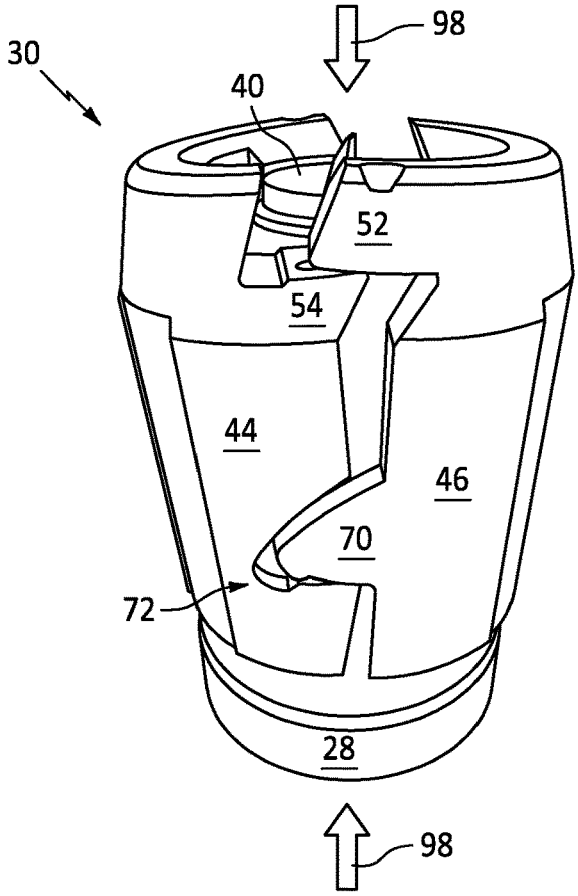
FIG. 17 is a schematic representation of an exemplary sabot being partially disassembled/detached from the forward assembly.
Figure 18:
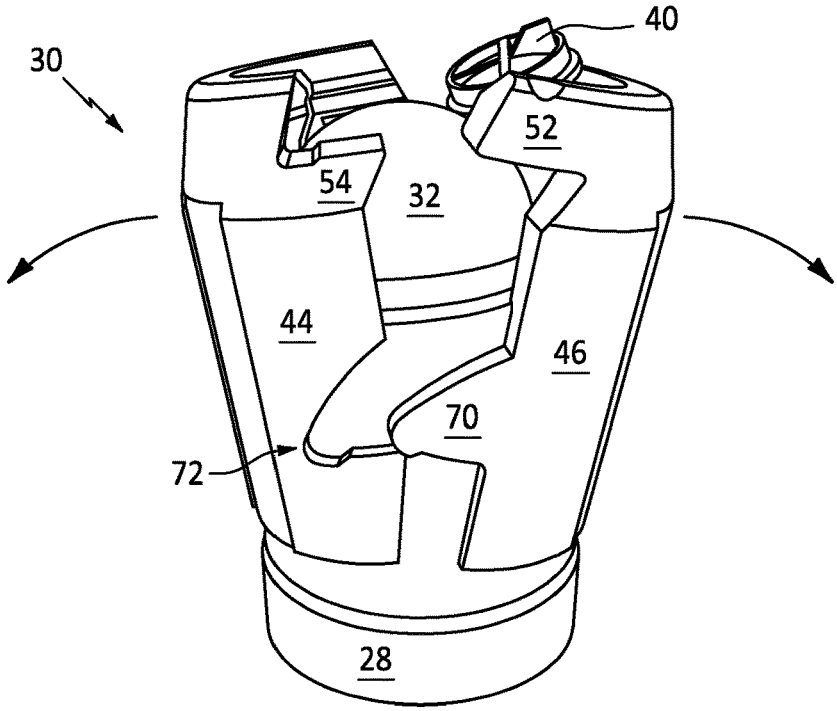
FIG. 18 is a schematic representation of an exemplary sabot being partially disassembled/detached from the forward assembly.

Referring also to FIG. 13 through FIG. 18, a sequence of images is shown to further describe the function of the sabot 30 after launch. FIG. 13 shows an exemplary forward assembly 28 without the sabot 30 mounted. FIG. 14 shows an exemplary sabot 30 with parts 40, 44, 46 separated. FIG. 15 and FIG. 16 show the sabot 30 assembled on the forward assembly 28. After the initial launch of the missile 18 out of the cartridge case 16 explosive gases surge forward along the barrel (not shown) as well as inside the cartridge case 16 and externally of the missile 18. The missile 18 accelerates down the barrel toward the muzzle. After the missile 18 clears the barrel muzzle, there are no longer any barrel constraints on the sabot exterior 124. As seen in FIG. 17, the decoupling force 98 can be applied to the sabot 30 that initiates the first casing petal 44 and second casing petal 46 becoming decoupled after being unlocked at the latch 86. As described above, the latch 86 can have any number of initiating events to become unlatched. An example can be that the decoupling force 98 creates enough force to overcome the force of the detent 94 and keeper 96 in the latch 86. The decoupling force 98 can be from the momentum of the missile 18, aerodynamic forces acting on the sabot 30, gas pressures, a contained forcing compression spring, an active explosive charge and the like. The first casing petal 44 and second casing petal 46 separate relative to the axis A. Upon initiation of the latch 86, by movement of the keeper 96 from the detent 94 the forces acting against the petals 44, 46 drive them apart. The arm 52 is free to slide along the landing 45 and separate. The hook 70 can freely rotate away from and separate from the notch 72 as a result of the slot 110 allowing for freedom of travel at the first disengagement feature 108. The keys 100 disconnect from the slots 104 of the forward assembly 28. The first casing petal 44 and the second casing petal 46 can tumble away from the forward assembly 28 and clear away from the missile 18 at some predetermined time after exiting the muzzle of the barrel. The cap 40 also is configured to disengage from the forward assembly 28 and move clear of the dome 32, exterior surface 34 and missile 28 altogether. The aerodynamic feature 138 on the cap 40 act on the cap 40 and remove the cap 40 from the dome 32.

It is contemplated that the sabot 30 can be constructed using Additive Manufacturing techniques. In an exemplary embodiment, the sabot can be constructed with materials such as carbon fiber filled nylon 12 utilizing powder bed laser fusion.

A technical advantage of the disclosed sabot includes a sabot configured to provide protection for elements of the forward assembly, principally the seeker optics, from damage and contamination in the gun barrel environment upon firing.

Another technical advantage of the disclosed sabot includes providing protection to not only the seeker but other forward assembly components such as the GPS antenna during round handling and transport.

Another technical advantage of the disclosed sabot includes providing protection to the forward assembly at all times until flight of the missile.

Another technical advantage of the disclosed sabot includes withstanding launch acceleration of up to 8500 g.

Another technical advantage of the disclosed sabot includes the capability to withstand barrel surface contact and offer low friction while traveling through the barrel.

Another technical advantage of the disclosed sabot includes meeting forward pressures of approximately 100 psi.

Another technical advantage of the disclosed sabot includes an assembled mass of less than 1.5 pounds and preferably less than 1 pound.

Another technical advantage of the disclosed sabot includes a configuration that maintains attachment to the forward assembly while allowing blow-by gas to escape.

Another technical advantage of the disclosed sabot includes maintaining attachment to the forward assembly during transport and handling of the munition.

Another technical advantage of the disclosed sabot includes a configuration that allows the sabot to passively and freely release from the forward assembly upon exit from the muzzle of the barrel.

Another technical advantage of the disclosed sabot includes a configuration that can tumble freely and rapidly disperse kinetic energy upon exit from the muzzle.

Another technical advantage of the disclosed sabot includes a configuration that can fit and attach to a variety of munitions.

Another technical advantage of the disclosed sabot includes a configuration that conforms with the cartridge assembly size parameters.

Another technical advantage of the disclosed sabot includes a configuration that allows the sabot to ride in the bore of the barrel.

There has been provided a sabot. While the sabot has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A sabot comprising:

a first casing petal having at least one coupling feature and at least one disengagement feature;

a second casing petal having at least one coupling feature and at least one disengagement feature; and a cap insertable within a forward receiver formed by coupling said first casing petal with said second casing petal, wherein said first casing petal and said second casing petal and said cap are configured to cooperatively attach to a forward assembly of a missile and cooperatively detach from the forward assembly of the missile responsive to a missile launch; wherein said at least one coupling feature comprises a hook and a notch cooperatively coupled, wherein said hook is a projection from the first casing petal, the hook comprising a curved portion; and wherein the notch is formed in the second casing petal, the notch includes a pitched face, formed at an angle relative to an axis A, the pitched face cooperates with the curved portion of the hook.

2. The sabot according to claim 1, wherein each of the first casing petal and the second casing petal are identically shaped.

3. The sabot according to claim 1, wherein said at least one coupling feature comprises an arm and a landing cooperatively coupled proximate a forward sabot end.

4. The sabot according to claim 3, wherein said at least one coupling feature comprises a central interface formed between the first casing petal and the second casing petal near the arm and landing; wherein the central interface includes a crotch at a base end of the arm configured to receive a nub proximate the landing of the second casing petal.

5. The sabot according to claim 3, further comprising:

a latch comprising a lock pin that rides in a first bore formed in said first casing petal and complementary second bore formed in said second casing petal; the first bore being located within the arm, the second bore being located adjacent the landing.

6. The sabot according to claim 1, further comprising:

a forward assembly receiving cavity formed by the first casing petal and the second casing petal being coupled together, said forward assembly receiving cavity being configured to receive the forward assembly.

7. The sabot according to claim 1, wherein said at least one coupling feature comprises a key formed in each of the first casing petal and the second casing petal, wherein the key comprises raised portions including an inclined surface clip that engages a slot formed in an exterior surface of the forward assembly.

8. The sabot according to claim 1, wherein said at least one disengagement feature includes a slot formed proximate a sabot aft end, wherein the slot includes a swept edge of the sabot proximate the notch, the slot being proximate an adjacent portion proximate the aft sabot end of the first casing petal and configured to swing in a radial direction, such that a forward sabot end swings radially in an opposite direction relative to the axis A.

9. The sabot according to claim 1, further comprising a blow-by vent comprising a groove adjacent ridges formed in a sabot exterior.

10. A sabot comprising:

a first casing petal having at least one coupling feature and at least one disengagement feature;

a second casing petal having at least one coupling feature and at least one disengagement feature; and a cap insertable within a forward receiver formed by coupling said first casing petal with said second casing petal, wherein said first casing petal and said second casing petal and said cap are configured to cooperatively attach to a forward assembly of a missile and cooperatively detach from the forward assembly of the missile responsive to a missile launch; wherein said at least one disengagement feature comprises an air scoop located within the forward receiver, the air scoop comprising a slot formed in each of the first casing petal and the second casing petal proximate the forward receiver, wherein the air scoop is configured for air to flow inward through the forward receiver and past a perimeter of the cap to enter a forward assembly receiving cavity of the sabot.

11. A sabot comprising:

a first casing petal having at least one coupling feature and at least one disengagement feature;

a second casing petal having at least one coupling feature and at least one disengagement feature; and a cap insertable within a forward receiver formed by coupling said first casing petal with said second casing petal, wherein said first casing petal and said second casing petal and said cap are configured to cooperatively attach to a forward assembly of a missile and cooperatively detach from the forward assembly of the missile responsive to a missile launch; wherein said at least one disengagement feature includes an aerodynamic feature formed on a forward surface of said cap, said aerodynamic feature configured to interact with onrushing air to destabilize the cap to remove the cap at a predetermined time during the missile launch.

12. A process for covering and uncovering a forward assembly on a missile of a gun launched munition with a sabot comprising:

attaching a first casing petal to a portion of the forward assembly;

attaching a second casing petal to another portion of the forward assembly;

coupling together the first casing petal to the second casing petal using at least one coupling feature;

nesting a cap between the first casing petal and the second casing petal in a forward receiver formed by the first casing petal and the second casing petal proximate a forward end of the sabot;

responsive to a launch of the missile, actuating at least one disengagement feature of said sabot; wherein said at least one disengagement feature comprises at least one of:

a slot formed proximate a sabot aft end, wherein the slot includes a swept edge of the sabot proximate the notch, the slot being proximate an adjacent portion proximate the aft sabot end of the first casing petal and configured to swing in a radial direction, such that a forward sabot end swings radially in an opposite direction relative to an axis A;

an air scoop located within the forward receiver, the air scoop comprising a slot formed in each of the first casing petal and the second casing petal proximate the forward receiver; and an aerodynamic feature formed on a forward surface of said cap, said aerodynamic feature configured to interact with onrushing air to destabilize the cap to remove the cap at a predetermined time;

removing said first casing petal and said second casing petal from said forward assembly; and removing said cap from said forward receiver and away from said forward assembly.

13. The process of claim 12, wherein the first casing petal and the second casing petal are identically shaped.

14. The process of claim 12, wherein actuating said disengagement feature comprises releasing a latch, the latch comprising a lock pin that rides in a first bore formed in said first casing petal and complementary second bore formed in said second casing petal.

15. The process of claim 12, wherein said at least one coupling feature comprises at least one of:

an arm and a landing cooperatively coupled or decoupled proximate a forward sabot end;

a central interface formed between the first casing petal and the second casing petal near the arm and landing;

a hook formed in the first casing petal and a notch formed in the second casing petal, said hook and said notch cooperatively coupled or decoupled; and a key formed in each of the first casing petal and the second casing petal, wherein the key comprises raised portions including an inclined surface clip that engages a slot formed in an exterior surface of the forward assembly.

16. The process of claim 12, further comprising:

venting gases past the sabot by use of a blow-by vent comprising a groove adjacent ridges formed in a sabot exterior.

17. The process of claim 12, further comprising:

actuation of said at least one disengagement feature responsive to a decoupling force, said decoupling force being selected from the group consisting of momentum of the missile, aerodynamic forces acting on the sabot, gas pressure, a spring, an explosive charge and combinations thereof.

18. The process of claim 12, further comprising:

the first casing petal and the second casing petal tumbling away from the forward assembly and clearing away from the missile; and the cap disengaging from the forward assembly and moving clear of a dome and exterior surface of the forward assembly and the missile at a predetermined time after exiting a muzzle of a barrel.

19. A sabot comprising:

a first casing petal having at least one coupling feature and at least one disengagement feature;

a second casing petal having at least one coupling feature and at least one disengagement feature; and a cap insertable within a forward receiver formed by coupling said first casing petal with said second casing petal, wherein said first casing petal and said second casing petal and said cap are configured to cooperatively attach to a forward assembly of a missile and cooperatively detach from the forward assembly of the missile responsive to a missile launch; wherein said at least one coupling feature comprises an arm and a landing cooperatively coupled proximate a forward sabot end; wherein said at least one coupling feature comprises a central interface formed between the first casing petal and the second casing petal near the arm and landing; wherein the central interface includes a crotch at a base end of the arm configured to receive a nub proximate the landing of the second casing petal.

20. A sabot comprising:

a first casing petal having at least one coupling feature and at least one disengagement feature;

a second casing petal having at least one coupling feature and at least one disengagement feature; and a cap insertable within a forward receiver formed by coupling said first casing petal with said second casing petal, wherein said first casing petal and said second casing petal and said cap are configured to cooperatively attach to a forward assembly of a missile and cooperatively detach from the forward assembly of the missile responsive to a missile launch; wherein said at least one coupling feature comprises an arm and a landing cooperatively coupled proximate a forward sabot end; and a latch comprising a lock pin that rides in a first bore formed in said first casing petal and complementary second bore formed in said second casing petal; the first bore being located within the arm, the second bore being located adjacent the landing.

21. A process for covering and uncovering a forward assembly on a missile of a gun launched munition with a sabot comprising:

attaching a first casing petal to a portion of the forward assembly;

attaching a second casing petal to another portion of the forward assembly;

coupling together the first casing petal to the second casing petal using at least one coupling feature;

nesting a cap between the first casing petal and the second casing petal in a forward receiver formed by the first casing petal and the second casing petal proximate a forward end of the sabot;

responsive to a launch of the missile, actuating at least one disengagement feature of said sabot; wherein actuating said at least one disengagement feature comprises releasing a latch, the latch comprising a lock pin that rides in a first bore formed in said first casing petal and complementary second bore formed in said second casing petal;

removing said first casing petal and said second casing petal from said forward assembly; and removing said cap from said forward receiver and away from said forward assembly.

* * * * *